US006685105B1

(12) United States Patent
Ruehle et al.

(10) Patent No.: US 6,685,105 B1
(45) Date of Patent: Feb. 3, 2004

(54) FUEL INJECTION VALVE

(75) Inventors: Wolfgang Ruehle, Ditzingen (DE); Hubert Stier, Asperg (DE); Matthias Boee, Ludwigsburg (DE); Guenther Hohl, Stuttgart (DE); Norbert Keim, Loechgau (DE)

(73) Assignee: Robert Bosch GmbH, Stuttgart (DE)

( * ) Notice: Subject to any disclaimer, the term of this patent is extended or adjusted under 35 U.S.C. 154(b) by 127 days.

(21) Appl. No.: 09/868,683

(22) PCT Filed: Oct. 21, 2000

(86) PCT No.: PCT/DE00/03731

§ 371 (c)(1),
(2), (4) Date: Sep. 27, 2001

(87) PCT Pub. No.: WO01/29403

PCT Pub. Date: Apr. 26, 2001

(30) Foreign Application Priority Data

Oct. 21, 1999 (DE) ..... 199 50 760

(51) Int. Cl.[7] ..... B05B 1/08; B05B 1/30; F02M 61/20

(52) U.S. Cl. ..... 239/102.1; 239/585.1; 239/585.3; 239/585.5; 239/533.9

(58) Field of Search ..... 239/88, 89, 91, 239/102.2, 102.1, 533.2, 533.3, 533.9, 585.1, 585.2, 585.3, 585.4, 585.5, 533.8; 251/129.15, 129.21, 127

(56) References Cited

U.S. PATENT DOCUMENTS 4,728,074 A * 3/1988 Igashira et al. ..... 251/57
5,176,115 A * 1/1993 Campion ..... 123/179.17
6,079,641 A * 6/2000 Shinogle et al. ..... 239/533.4

FOREIGN PATENT DOCUMENTS

| | | |
|---|---|---|
| DE | 43 06 072 | 9/1994 |
| DE | 195 00 706 | 7/1996 |
| DE | 197 02 066 | 7/1998 |
| DE | 197 44 235 | 4/1999 |
| DE | 198 38 862 | 3/2000 |
| EP | 0 864 743 | 9/1998 |

* cited by examiner

*Primary Examiner*—Davis Hwu
(74) *Attorney, Agent, or Firm*—Kenyon & Kenyon

(57) ABSTRACT

A fuel injector, in particular an injector for fuel injection systems in internal combustion engines, has a piezoelectric or magnetostrictive actuator, a valve closing body which can be operated by the actuator by way of a valve needle and which cooperates with a valve seat face to form a sealing seat, and having a hydraulic lifting device including two lifting cylinders that can move in opposite directions. The lifting device is a subassembly hermetically sealed off from a valve interior and has a housing having at least one section which is flexible in the axial direction.

12 Claims, 1 Drawing Sheet

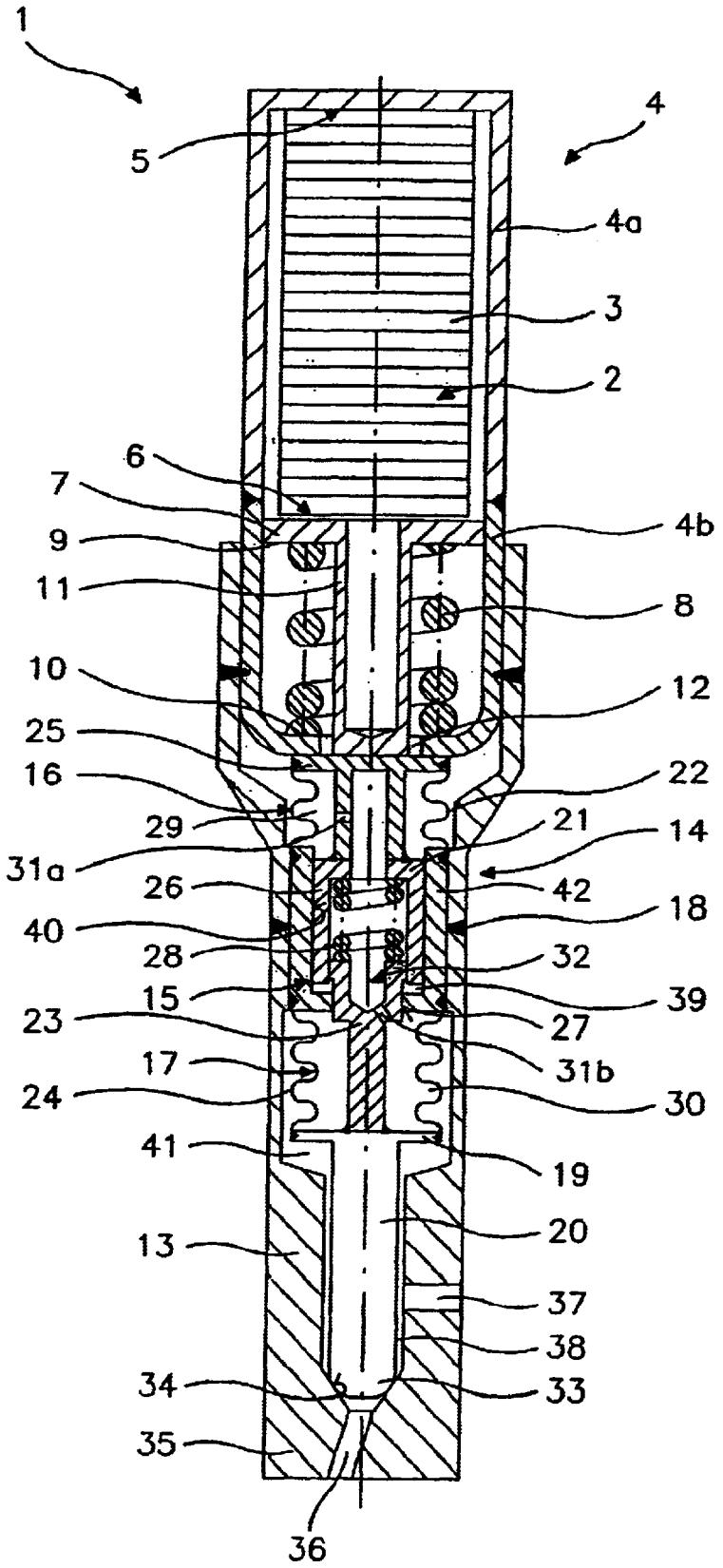
1
5
4
4a
3
2
6
7
9
4b
11
8
10
12
25
16
22
29
21
14
31a
26
42
18
40
28
32
15
39
23
27
17
31b
24
30
41
19
13
20
37
38
34
33
35
36

FUEL INJECTION VALVE

FIELD OF THE INVENTION

The present invention relates to a fuel injector.

BACKGROUND INFORMATION

A fuel injector is described in German Published Patent Application No. 195 00 706.

The device for metering of liquids and gases, in particular in fuel injectors in internal combustion engines as described in German Published Patent Application No. 195 00 706, has a hydraulic travel amplifier for converting the actuator travel of a piezoelectric actuator into an enlarged lift of a valve needle. In order to integrate the travel amplifier into the valve housing in a small volume, the lifting cylinder of the path amplifier is provided with an end section having a reduced diameter that projects into a recess in the working piston of the path amplifier. A disk spring inserted into the amplifier chamber bordered by the piston applies the working piston to the actuator, and a helical compression spring arranged concentrically with the end section in the recess presses the lifting cylinder against the valve needle.

Effects of wear, manufacturing tolerances, and changes in temperature on the actuator travel are compensated by providing a fluid-filled hollow cylindrical throttle gap on the guide surfaces of the amplifier pistons between the amplifier pistons and between the amplifier pistons and the inside wall of the valve housing, through which the amplifier chamber communicates with a fluid-filled low-pressure space. The volume defined by the amplifier chamber, the throttle gaps and the low-pressure space is closed.

One disadvantage of the lifting device known from German Published Patent Application No. 195 00 706 is mainly the complicated design and the length of the valve. Furthermore, there is a high cavitation tendency in the throttle gaps due to the large displacement volumes.

German Patent No. 197 02 066 describes a fuel injector in which the change in length of the actuator is compensated by an appropriate combination of materials. The fuel injector known from this publication has an actuator which is guided in a valve housing under a spring pre-tension and works together with an actuating part composed of an actuating body and a head part; the head part rests on the piezoelectric actuator and the actuating body passes through an internal recess in the actuator. The actuating body is mechanically linked to a valve needle. In operation of the actuator, the valve needle is operated against the spray direction.

The actuator and the actuating body have at least approximately the same length and are made of a ceramic material or a material which resembles ceramic in terms of thermal expansion. The result of using materials such as INVAR in the same lengths and having the same coefficients of thermal expansion is that the actuator and the actuating body expand uniformly under the influence of heat.

The main disadvantage of this arrangement is its limited suitability for use in systems subject to great temperature fluctuations. The arrangement known from German Patent No. 197 02 066 does not achieve the present object due to the nonlinear characteristic of the thermal expansion coefficient of piezoceramic materials with varying temperature. Another disadvantage is the great manufacturing complexity which is associated with a relatively high cost due in particular to the choice of materials (e.g., INVAR).

SUMMARY OF THE INVENTION

The fuel injector according to the present invention has the advantage over the related art that temperature compensation does not depend on the coefficients of thermal expansion of the piezoceramic material. Thermal expansion is compensated by a hermetically sealed lifting device. This guarantees reliable and accurate operation of the fuel injector. The lifting device may be prefabricated as an independent subassembly, optionally in one unit together with the valve needle, and filled with a suitable hydraulic medium before being inserted into the fuel injector.

Due to the hermetic seal of the lifting device, leakage losses and an influx of fuel into the lifting device are prevented.

The design of the flexible sections as corrugated pipes is simple to manufacture and is thus inexpensive. Corrugated pipes are also advantageous for the equalizing volumes, because expansion of the hydraulic medium due to temperature is compensated by the flexibility of the corrugated pipe.

The guidance of the lifting cylinders in one another or in the stationary section of the housing without projections ensures a low tendency to skewing and thus ensures trouble-free operation even at high operating speeds.

Due to the large-dimension bores in the lifting cylinder in comparison with the leakage gap, there is little tendency to cavitation due to flow and turbulence.

BRIEF DESCRIPTION OF THE DRAWING

The FIGURE shows an axial section through an embodiment of a fuel injector according to the present invention.

DETAILED DESCRIPTION

The FIGURE shows an axial sectional diagram of one embodiment of a fuel injector 1 according to the present invention. This is an inward-opening fuel injector 1. In particular, fuel injector 1 is used for direct injection of fuel into the combustion chamber of an internal combustion engine having fuel mixture compression and spark ignition.

An actuator 2, preferably composed of disk-shaped piezoelectric or magnetostrictive elements 3, is arranged in a two-part actuator housing 4. At a first end face 5, actuator 2 is surrounded by a sleeve-like first actuator housing part 4a having a cover part, and at a second end face 6 it is in contact with an actuator flange 7. A pre-tension spring 8 is in contact at a first end 9 with actuator flange 7 and is surrounded by a sleeve-shaped second actuator housing part 4*b* on which second end 10 of pre-tension spring 8 is supported. The two actuator housing parts 4*a* and 4*b* are welded together, for example. Second actuator housing part 4*b* is permanently joined to a valve housing 13, e.g., by welding. Actuator flange 7 continues in an actuator piston 11 surrounded by pre-tension spring 8.

Actuator piston 11 projects through a recess 12 provided in second actuator housing part 4*b*. Actuator piston 11 and second actuator housing part 4*b* are in contact with a lifting device 14 which is hermetically sealed with respect to a valve interior 41 and is filled with a hydraulic medium. A housing 15 of lifting device 14 is composed of a stationary section 42 arranged between a first flexible section 16 and a second flexible section 17. Stationary section 42 is preferably attached to valve housing 13 by a weld 18.

First flexible section 16 surrounds a first lifting cylinder 21 and is designed as a first corrugated pipe 22. On the spray end, first corrugated pipe 22 is welded to stationary section 42 and at its other end it is welded to first lifting cylinder 21. Second flexible section 17 surrounds a second lifting cylinder 23, is designed as a second corrugated pipe 24 and is welded to a flange 19 of a valve needle 20. Second corrugated pipe 24 is also welded to stationary section 42.

In the present embodiment, first lifting cylinder 21 is designed in two parts, an intermediate piece 25 which is in contact with actuator piston 11 and communicates with first corrugated pipe 22 and a tubular piston 26 which is guided in stationary section 42 which is also tubular.

Second lifting cylinder 23 passes through a recess 27 in the spray end of stationary section 42 and is guided in piston 26. Second lifting cylinder 23 is connected to the end of valve needle 20 which widens to form flange 19. In this embodiment, second corrugated pipe 24 is mounted on flange 19. Lifting cylinders 21 and 23 are movable in opposite directions and are pressed apart by a closing spring 28 inside piston 26, so that fuel injector 1 remains closed.

First corrugated pipe 22 encloses a first equalizing space 29; second corrugated pipe 24 encloses a second equalizing space 30. Equalizing spaces 29 and 30 are interconnected through a bore 31*a* in intermediate piece 25 and a bore 31*b* in second lifting cylinder 23 and through a central recess 32. The hydraulic medium can thus be equalized freely in lifting device 14.

First lifting cylinder 21, second lifting cylinder 23 and stationary section 42 of housing 15 enclose an annular transfer volume 39 filled with hydraulic medium. It transfers the momentum from actuator 2 to valve needle 20, amplifying the small actuator stroke to a larger valve needle lift and compensating for temperature-induced expansion of actuator 2 and lifting device 14. A leakage gap 40 of a defined size provided between housing 15 and piston 26 allows hydraulic medium to flow out of transfer volume 39 into equalizing spaces 29 and 30 in the case of slow, temperature-induced movements of lifting cylinders 21 and 23.

A valve closing body 33 working together with a valve seat face 34 to form a sealing seat is provided on valve needle 20. At least one spray opening 36 is provided in a valve seat body 35, which is designed here in one piece with valve housing 13. Fuel is sent through a fuel inlet 37 designed in the side of valve housing 13, passing through an interspace 38 between valve needle 20 and valve housing 13 to the sealing seat.

When an excitation voltage is sent to piezoelectric actuator 2 by an electronic controller (not shown) and a plug contact, disk-shaped piezoelectric elements 3 of actuator 2 expand against the tension of pre-tension spring 8 and move actuator flange 7 together with actuator piston 11 in the spray direction. The stroke is transferred over intermediate piece 25 and piston 26 to transfer volume 39. The hydraulic medium is displaced by piston 26 moving in the spray direction and presses second lifting cylinder 23 in the direction of actuator 2 against the spring tension of closing spring 28. Second lifting cylinder 23 entrains valve needle 20 which is welded to it, so that valve closing body 33 is lifted up form valve seat face 34 and fuel is sprayed through spray opening 36 in valve seat body 35.

Since the switching operation takes place very rapidly, the hydraulic medium enclosed in transfer volume 39 does not have any opportunity to escape through leakage gap 40 and therefore has incompressible behavior and the momentum is transferred.

On the other hand, if fuel injector 1 heats up due to external temperature effects, power loss or charge transfer in actuator 2, the change in length of actuator 2 takes place slowly. If piston 26 moves slowly in the spray direction in stationary housing 15, hydraulic medium is displaced through leakage gap 40 out of transfer volume 39, and no momentum is transferred to second lifting cylinder 23. It remains in the resting position and fuel injector 1 thus remains in the closed position.

The present invention is not limited to the embodiment illustrated here, but instead can also be implemented in a variety of other designs of fuel injectors 1, in particular in fuel injectors 1 that open outward.

What is claimed is:

1. A fuel injector, comprising:

one of a piezoelectric actuator and a magnetostrictive actuator;

a valve needle;

a valve seat face;

a valve closing body that can be operated by the one of the piezoelectric actuator and the magnetostrictive actuator by way of the valve needle and that cooperates with the valve seat face to form a sealing seat; and a hydraulic lifting device including a first lifting cylinder and a second lifting cylinder, wherein:

the hydraulic lifting device is a subassembly that is hermetically sealed off from a valve interior, and a housing of the hydraulic lifting device includes at least one section that is flexible in an axial direction.

2. The fuel injector according to claim 1, wherein:

the fuel injector is for a fuel injection system in an internal combustion engine.

3. The fuel injector according to claim 1, further comprising:

an actuator piston for mechanically linking the first lifting cylinder to the one of the piezoelectric actuator and the magnetostrictive actuator.

4. The fuel injector according to claim 1, wherein:

the second lifting cylinder is mechanically linked to a flange of the valve needle.

5. A fuel injector, comprising:

one of a piezoelectric actuator and a magnetostrictive actuator;

a valve needle;

a valve seat face;

a valve closing body that can be operated by the one of the piezoelectric actuator and the magnetostrictive actuator by way of the valve needle and that cooperates with the valve seat face to form a sealing seat;

a hydraulic lifting device including a first lifting cylinder and a second lifting cylinder; and a valve housing, wherein;

the hydraulic lifting device is a subassembly that is hermetically sealed off from a valve interior, a housing of the hydraulic lifting device includes at least one section that is flexible in an axial direction, the housing of the hydraulic lifting device includes a stationary section connected to the valve housing, the at least one section that is flexible in the axial direction includes a first flexible section and a second flexible section, the first flexible section is fixedly connected to the stationary section and the first lifting cylinder, and the second flexible section is fixedly connected to the stationary section and one of the second lifting cylinder and the valve needle that is operated by the second lifting cylinder.

6. The fuel injector according to claim 5, wherein:

the first flexible section includes a first corrugated pipe, and the second flexible section includes a second corrugated pipe.

7. The fuel injector according to claim 5, wherein:

the first flexible section and the first lifting cylinder enclose a first equalizing volume, and the second flexible section and the second lifting cylinder enclose a second equalizing volume.

8. The fuel injector according to claim 7, wherein:

the first equalizing volume and the second equalizing volume communicate through bores in the first lifting cylinder and the second lifting cylinder.

9. A fuel injector, comprising:

one of a piezoelectric actuator and a magnetostrictive actuator;

a valve needle;

a valve seat face;

a valve closing body that can be operated by the one of the piezoelectric actuator and the magnetostrictive actuator by way of the valve needle and that cooperates with the valve seat face to form a sealing seat; and a hydraulic lifting device including a first lifting cylinder and a second lifting cylinder, wherein:

the hydraulic lifting device is a subassembly that is hermetically sealed off from a valve interior, a housing of the hydraulic lifting device includes at least one section that is flexible in an axial direction, the first lifting cylinder and the second movable lifting cylinder are movable in opposite directions, and the first lifting cylinder and the second movable lifting cylinder are encapsulated in the housing of the hydraulic lifting device.

10. A fuel injector, comprising:

one of a piezoelectric actuator and a magnetostrictive actuator;

a valve needle;

a valve seat face;

a valve closing body that can be operated by the one of the piezoelectric actuator and the magnetostrictive actuator by way of the valve needle and that cooperates with the valve seat face to form a sealing seat;

a hydraulic lifting device including a first lifting cylinder and a second lifting cylinder; and a closing spring secured between the first lifting cylinder and the second lifting cylinder, wherein:

the hydraulic lifting device is a subassembly that is hermetically sealed off from a valve interior, and a housing of the hydraulic lifting device includes at least one section that is flexible in an axial direction.

11. A fuel injector, comprising:

one of a piezoelectric actuator and a magnetostrictive actuator;

a valve needle;

a valve seat face;

a valve closing body that can be operated by the one of the piezoelectric actuator and the magnetostrictive actuator by way of the valve needle and that cooperates with the valve seat face to form a sealing seat; and a hydraulic lifting device including a first lifting cylinder and a second lifting cylinder, wherein:

the hydraulic lifting device is a subassembly that is hermetically sealed off from a valve interior, a housing of the hydraulic lifting device includes at least one section that is flexible in an axial direction, and the first lifting cylinder, the second lifting cylinder, and a stationary section of the hydraulic lifting device enclose a transfer volume filled with a hydraulic medium.

12. The fuel injector according to claim 11, wherein:

a leakage gap that allows an equalization of the hydraulic medium is located between the housing of the hydraulic lifting device and at least one of the first lifting cylinder and the second lifting cylinder.

* * * * *